US009079291B2

(12) United States Patent
Ikuta et al.

(10) Patent No.: US 9,079,291 B2
(45) Date of Patent: Jul. 14, 2015

(54) HAND-HELD TOOLS

(75) Inventors: Hiroki Ikuta, Anjo (JP); Hikaru Sunabe, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 904 days.

(21) Appl. No.: 13/205,060

(22) Filed: Aug. 8, 2011

(65) Prior Publication Data

US 2012/0037392 A1 Feb. 16, 2012

(30) Foreign Application Priority Data

Aug. 16, 2010 (JP) ..... 2010-181546
Jun. 21, 2011 (JP) ..... 2011-137046

(51) Int. Cl.
*B24B 47/12* (2006.01)
*B24B 23/02* (2006.01)
*B24B 55/05* (2006.01)

(52) U.S. Cl.
CPC ..... *B24B 55/05* (2013.01); *B24B 23/028* (2013.01); *B24B 55/052* (2013.01)

(58) Field of Classification Search
CPC ..... B24B 7/18; B24B 55/05; B24B 55/052; B24B 55/04; B24B 23/028; B23D 47/00
USPC ..... 451/344, 354, 356, 357, 358, 359, 451, 451/454, 457; 173/216
See application file for complete search history.

(56) References Cited

U.S. PATENT DOCUMENTS 4,924,635 A * 5/1990 Rudolf et al. ..... 451/344
5,386,667 A 2/1995 Hausslein et al.
5,637,035 A * 6/1997 Yee ..... 451/358
5,766,062 A * 6/1998 Edling ..... 451/451
6,632,128 B2 * 10/2003 Berger et al. ..... 451/358
6,949,017 B2 * 9/2005 Koschel et al. ..... 451/358
7,063,606 B2 * 6/2006 Stierle et al. ..... 451/359
2002/0094769 A1 7/2002 Lai et al.
2005/0215186 A1 9/2005 Stierle et al.
2008/0280549 A1 * 11/2008 Sulea et al. ..... 451/451
2009/0207035 A1 8/2009 Watanabe et al.
2010/0178857 A1 7/2010 Esenwein

FOREIGN PATENT DOCUMENTS

CN 1852785 A 10/2006
CN 101508106 A 8/2009
DE 10 2006 053 305 A1 5/2008
DE 10 2007 052 683 A1 5/2009

OTHER PUBLICATIONS

Oct. 2, 2013 Extended European Search Report issued in European Application No. 11177201.8.
Chinese Office Action issued in Chinese Patent Application No. CN 201110236353.8 dated Sep. 6, 2013 (w/ partial translation).
Sep. 24, 2014 Office Action issued in Japanese Patent Application No. 2011-137046 (with translation).

* cited by examiner

*Primary Examiner* — Thanh Truong
*Assistant Examiner* — Justin Citrin
(74) *Attorney, Agent, or Firm* — Oliff PLC

(57) ABSTRACT

A hand-held tool has an operation member operably coupled to a lock mechanism. The lock mechanism can lock and unlock the position of a cover that covers at least a part of an end tool. The operation member is positioned on an opposite side to a coupling device that movably couples the cover to a gear head device mounted to a tool body.

12 Claims, 7 Drawing Sheets

HAND-HELD TOOLS

This application claims priority to Japanese patent application serial numbers 2010-181546 and 2011-137046 and, the contents of which are incorporated herein by reference.

BACKGROUND OF THE INVENTION

1. Field of the Invention

The present invention relates to hand-held tools, such as a hand-held disk grinder.

2. Description of the Related Art

A known hand-held disk grinder has a tool body that has an electric motor disposed therein and serves also as a grip portion for being grasped by an operator. A gear head is assembled with a front portion of the tool body and is coupled to a spindle, to which a circular grinding wheel (i.e., an end tool) is mounted. The gear head has a bevel gear disposed therein. An axis of the spindle or the rotational axis of the grinding wheel extends perpendicular to a motor axis of the motor.

In general, the disk grinder has a grinding wheel cover that surrounds the grinding wheel for preventing ground powder or the like produced during a grinding operation from scattering toward the side of the operator. The grinding wheel cover includes a substantially semi-circular cover body surrounding the grinding wheel and an annular cover mounting portion secured to a bearing box in such a manner that it is wound around the bearing box. The bearing box may be positioned at the lower portion of the gear head and has a bearing disposed therein for rotatably supporting the spindle.

Because the disk grinder is grasped while it is oriented in various directions according to different modes of operation, the grinding wheel cover is configured such that it can be moved to a desired position around the grinding wheel (i.e., about the spindle axis) according to the orientation of the grinding wheel cover. In order to change the position of the grinding wheel cover, for example, a fixing screw tightening type structure is incorporated. According to this type of structure, a fixing screw of the cover mounting portion is loosened, the grinding wheel cover is moved to a desired position, and the cover mounting portion is then fixed in position by tightening the fixing screw. However, because this type of structure requires a tool, such as a screwdriver, the position changing operation is troublesome. Therefore, there has been proposed a tool-less type structure that enables the position of the grinding wheel cover to be changed and fixed at one-touch without need of a tool. Techniques relating to a tool-less type structure for changing a position of a grinding wheel cover are disclosed in U.S. Pat. No. 4,924,635 (also published as Japanese Patent Publication No. 5-79466) and U.S. Pat. No. 5,386,667 (also published as Japanese Patent No. 3447287). With these techniques, it is possible to improve the operability of the grinding wheel, enabling to quickly perform the girding operation.

However, according the techniques disclosed in the above U.S. patents, an operation member for locking and unlocking the position of the grinding wheel cover is positioned at or in the vicinity of the grinding wheel cover support portion, and therefore, it is difficult for the operator to view the operation member.

Therefore, there is a need in the art for a hand-held tool that is further improved in its operability.

SUMMARY OF THE INVENTION

According to the present teaching, a hand-held tool has an operation member operably coupled to a lock mechanism.

The lock mechanism can lock and unlock the position of a cover that covers at least a part of an end tool. The operation member is positioned on an opposite side to a coupling device that movably couples the cover to a gear head device mounted to a tool body.

DETAILED DESCRIPTION OF THE INVENTION

Figure 1:
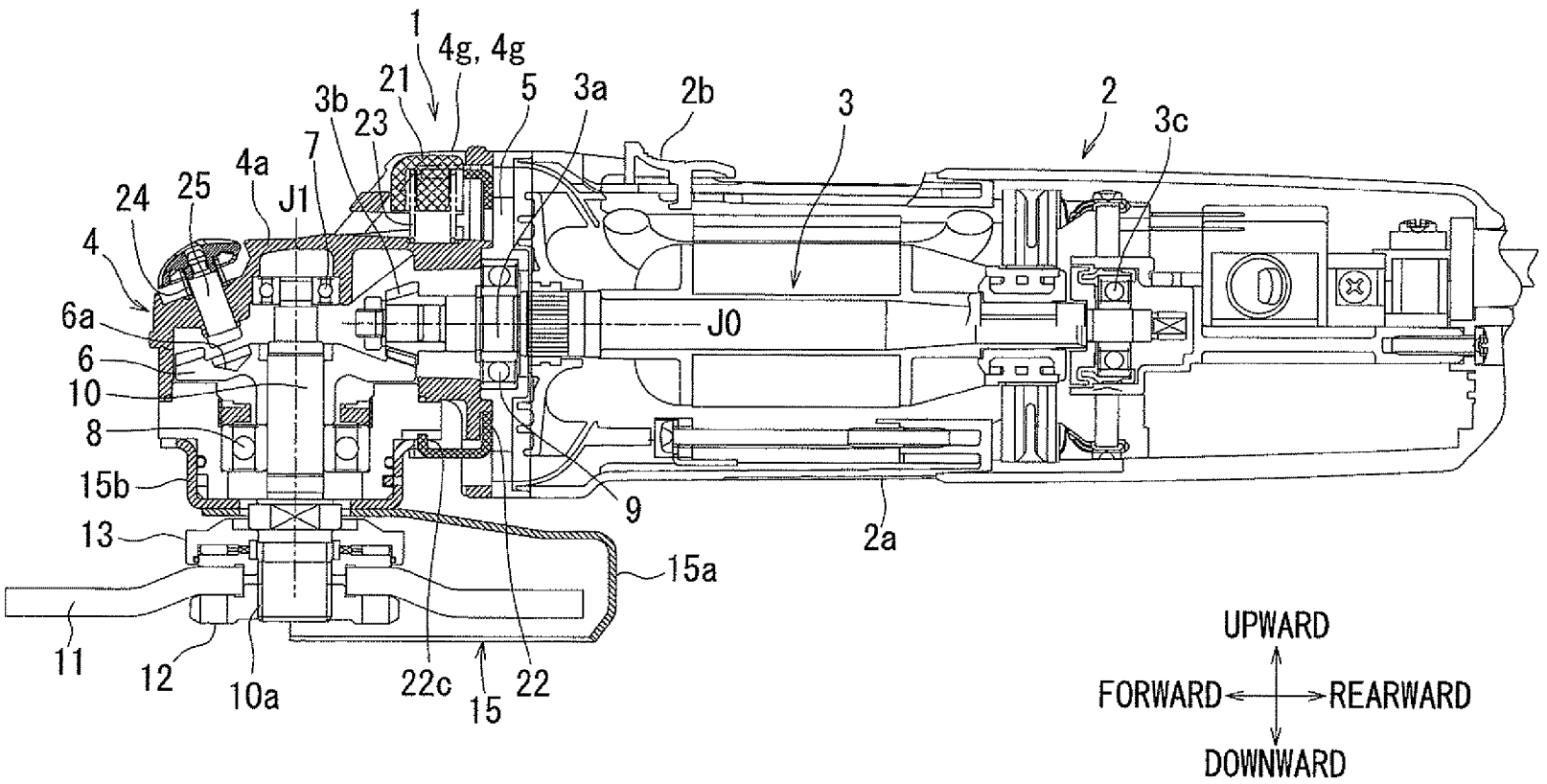
FIG. 1 is a vertical sectional view showing an internal structure of a hand-held tool according to a first example.

Each of the additional features and teachings disclosed above and below may be utilized separately or in conjunction with other features and teachings to provide improved hand-held tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a hand-held tool includes a tool body having an electric motor disposed therein, a gear head device disposed at a front portion of the tool body and having a gear mechanism configured to transmit rotation of the electric motor to a spindle, and a cover configured to cover an end tool mounted to the spindle and having a support portion supported by the gear head device and. The spindle is supported by the gear head device so as to be rotatable about an axis intersecting with a motor axis of the electric motor. The cover has a support portion supported by the gear head device so as to be capable of changing a position of the cover relative to the end tool. A lock mechanism configured to lock and unlock the position of the cover and including an operation member operable to lock and unlock the position of the cover. The operation member is positioned on an opposite side of the support portion of the cover with respect to the motor axis.

According to this arrangement, the operation member operable to lock and unlock the position of the cover relative to the end tool is positioned on an opposite side of the support portion of the cover, so that the lock mechanism can be operated remotely by the operation member. Therefore, for example, by positioning the operation member at the gear head device so as to be easily viewed by an operator, it is possible to improve the operability of the operation member. In addition, because the rotational axis of the spindle intersects with the motor axis, it is possible to position the operation member, for example, at the upper surface of the gear head device by positioning the side of the end tool mounted to the spindle on the lower side of the gear head device.

The lock mechanism may include a lock claw engaging the cover and fixing the cover in position relative to the end tool, a biasing member biasing the lock claw in a direction toward a lock position, and a retaining claw retaining the cover at a mounting position to the gear head device by the biasing force of the biasing member. The operation member may be operable to unlock the position of the cover against the biasing force of the biasing member.

Therefore, the unlock operation of the operation member is performed against the biasing force of the biasing member, and the operation member returns to the lock position when the operation member is released. When the operation member is moved to the unlock position, the engagement of the lock claw with the cover is released, so that the cover can be changed its position around the end tool. When the operation is released, the operation member moves to the lock position, so that the lock claw engages and locks the cover. Hence, it is possible to more reliably maintain the engagement of the lock claw with the cover.

The lock mechanism may further include a slider disposed on a rear side of the spindle and transmitting the lock and unlock operations of the operation member to the lock claw. The slider has a relief portion through which an output shaft of the electric motor extends in a direction of thickness of the slider.

With this arrangement, it is possible to compactly position the slider at a position on the rear side of the spindle. Because the gear head device is positioned on the front side of the tool body, the electric motor is positioned on the rear side of the spindle. In order to position the slider on the rear side of the spindle, it is necessary for the outputs shaft of the electric motor to pass through the slider in the direction of the thickness of the slider. Because the slider has the relief portion allowing the output shaft of the electric motor to extend therethrough, it is possible to compactly position the slider.

The hand-held tool may further include a bearing holder portion mounted to the tool body. The bearing holder portion holds a bearing rotatably supporting the output shaft of the electric motor. The slider may be supported by the bearing holder portion so as to be movable in a lock direction and an unlock direction. With this arrangement, the slider can slide smoothly between the lock position and the unlock position, while being compactly positioned.

The slider may have an engaging portion engaging with the operation member, so that the slider moves together with the operation member in moving directions of the operation member for the lock and unlock operations. The slider may move in the direction along the rotational axis of the spindle, which intersects with the motor axis and may be a vertical direction. Therefore, the lock mechanism locks and unlocks the cover according to the movement of the slider. In the case that the slider moves in the vertical direction, the lock claw may be provided at a lower portion of the slider for engaging the cover. In such a case, the engaging portion may be provided at an upper portion of the slider for engaging the operation member. With this arrangement, it is possible to operate the lock mechanism at a remote position from the lock mechanism by incorporating a minimum number of parts. In addition, the assembling operation of the operation member with the slider can be easily performed.

The hand-held tool may further include a resilient member interposed between the cover and the gear head device and biasing the cover in a direction of an axis of the spindle. With this arrangement, it is possible to prevent or suppress the movement of the cover relative to the gear head device.

Representative examples will now be described with reference to FIGS. 1 to 9. Referring to FIGS. 1 to 6, there is shown a hand-held tool 1 configured as a disk grinder according to a first example. The hand-held tool 1 generally includes a tool body 2 and a gear head device 4. The tool body 2 has a body housing 2*a* having a substantially cylindrical tubular configuration. An electric motor 3 serving as a drive source is disposed within the body housing 2*a*. The gear head device 4 is configured to reduce the rotational speed of the electric motor 3 and to transmit the rotation to the spindle 10 after being reduced.

The thickness and the shape of the body housing 2*a* of the tool body 2 are chosen to enable an operator to easily grasp the body housing 2*a* with one hand or both hands of the operator. A slide-type switch lever 2*b* is mounted to the upper surface of the body housing 2*a*. In the state that the operator grasps the body housing 2*a*, the operator can operate the switch lever 2*b* with his or her finger tip(s) to slide the switch lever 2*b* forwardly for starting the electric motor 3 or rearwardly for stopping the electric motor 3.

Figure 2:
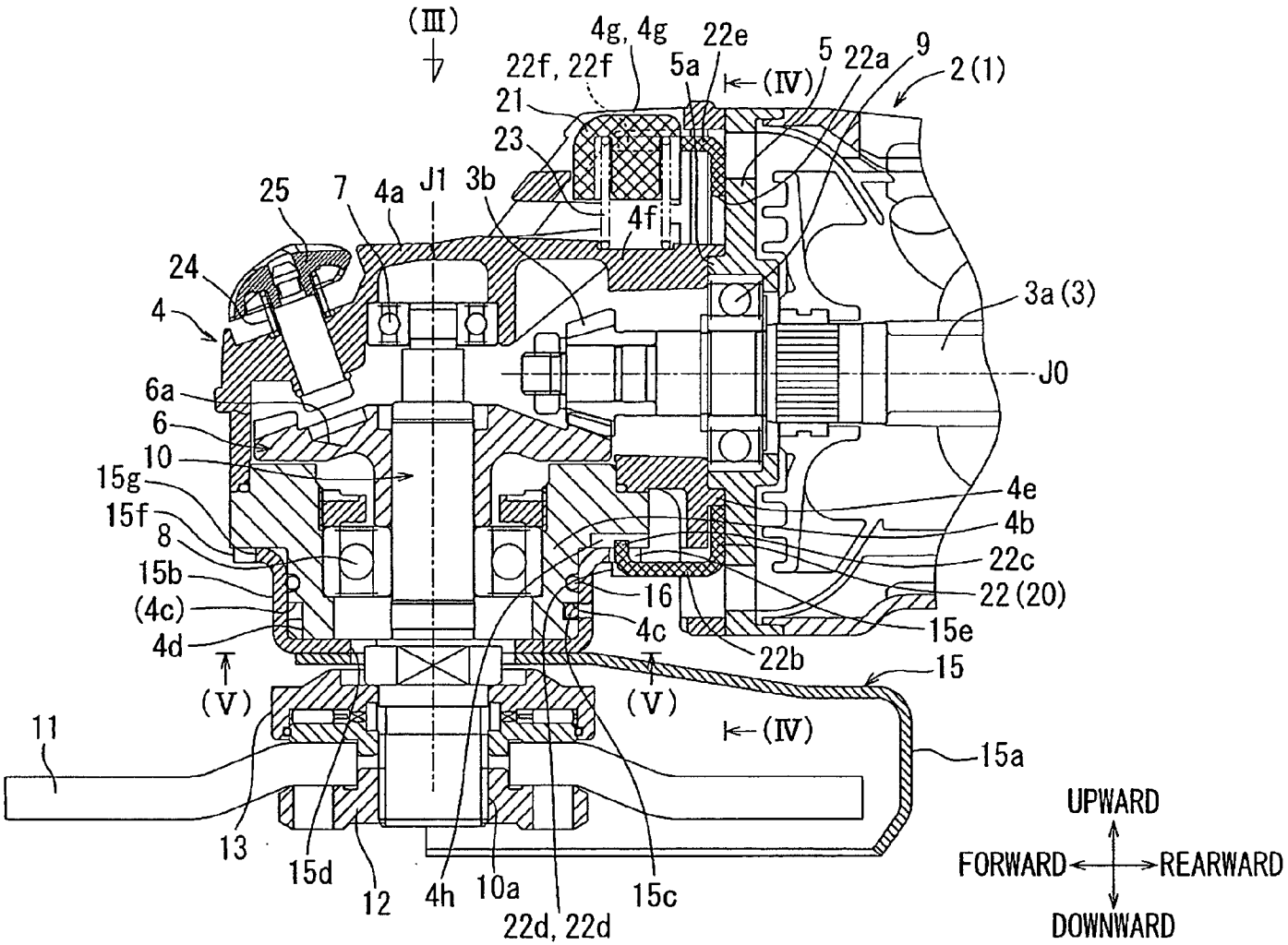
FIG. 2 is an enlarged view of an internal structure of a gear head device of the hand-held tool.

The gear head device 4 is mounted to the front portion of the tool body 2 and is shown in detail in FIG. 2. A flat plate-like bearing holder portion 5 is held between the tool body 2 and the gear head device 4. A bearing 9 is mounted to the bearing holder portion 5 for rotatably supporting the front portion of an output shaft 3*a* of the electric motor 3 relative to the body housing 2*a*. The rear portion of the output shaft 3*a* is rotatably supported by the body housing 2*a* via a bearing 3*c*.

The gear head device 4 includes a gear head housing 4*a* that may be an aluminum die-cast product. A bevel gear 6 is disposed within the gear head housing 4*a*. The output shaft 3*a* of the electric motor 3 protrudes into the gear head housing 4*a* from the rear side of the bevel gear 6. A drive gear 3*b* is fixedly mounted to the output shaft 3*a* and engages with the bevel gear 6. The bevel gear 6 is fixedly mounted to the spindle 10. The gear head housing 4*a* rotatably supports the upper portion and the lower portion of the spindle 10 via bearings 7 and 8, respectively.

Therefore, the rotation of the electric motor 3 is transmitted to the spindle 10 via the drive gear 3*b* and the bevel gear 6 of the gear head device 4 engaging with the drive gear 3*b*. To this end, a spindle axis J1, i.e., the rotational axis of the spindle 10, perpendicularly intersects with a motor axis J0, i.e., the rotational axis of the output shaft 3*a* of the electric motor 3.

The lower portion of the spindle 10 protrudes vertically downward from the lower portion of the gear head housing 4*a*. A circular end tool 11 (a grinding wheel in this example) is mounted to the lower portion of the spindle 10. More specifically, the end tool 11 is mounted to the lower portion of the spindle 10 so as to be coaxial with the spindle axis J1 and is held in position between a support flange 13 and a fixing nut 12. The fixing nut 12 is engaged with a threaded shaft portion 10*a* of the spindle 10 and is firmly tightened.

A cover 15 covers mainly the rear portion of the end tool 11. The cover 15 includes a cover body portion 15*a* and a body support portion 15*b*. The cover body portion 15*a* has a substantially semi-circular configuration for covering substantially half the end tool 11 along the outer circumference and the upper surface of the end tool 11. The body support portion 15*b* supports the cover body portion 15*a* against the gear head device 4. The body support portion 15*b* has a substantially cylindrical tubular configuration and is joined to the upper portion of the cover body portion 15*a*. An insertion hole 15*d* is formed to extend through the body support portion 15*b* and the cover body portion 15*a* at a joint portion between the body support portion 15*b* and the cover body portion 15*a*. The spindle 10 extends downwardly through the insertion hole 15*d*.

A support boss portion 4*b* is mounted to the lower portion of the gear head housing 4*a* and has a substantially cylindrical configuration that is coaxial with the spindle axis J1. The bearing 8 is mounted within the support boss portion 4*b*.

The lower portion of the support boss portion 4*b* is slidably fitted into the body support portion 15*b* without producing a substantial clearance therefrom, so that the cover 15 is supported by the gear head device 4 so as to be rotatable relative thereto about the spindle axis J1. A rubber ring 16 is fitted on the outer circumferential surface of the support boss portion 4*b* and applies an appropriate resistance against rotation of the body support portion 15*b* relative to the support boss portion 4*b*. An engaging groove 4*c* is formed in the outer circumferential surface of the support boss portion 4*b* throughout its entire circumferential length at a position on the lower side of the rubber ring 16. Three engaging projections 15*c* are formed on the inner circumferential surface of the body support portion 15*b* and are inserted into the engaging groove 4*c* so as to be movable in the circumferential direction along the engaging groove 4*c*. Due to engagement of the engaging projections 15*c* with the engaging groove 4*c*, the body support portion 15*b* and eventually the cover 15 is prevented from moving in the direction of the spindle axis J1, while being rotatably supported by the support boss portion 4*b*.

The three engaging projections 15*c* are spaced unequally from each other in the circumferential direction about the spindle axis J1. In correspondence with the three engaging projections 15*c*, three removal slots 4*d* are formed in the lower surface of the engaging groove 4*c* at positions spaced unequally from each other in the circumferential direction about the spindle axis J1 to correspond to the positions of the engaging projections 15*c*. More specifically, the removal slots 4*d* extend downwardly from the engaging groove 4*c* and are opened at the lower surface of the support boss portion 4*b*.

Figure 5:
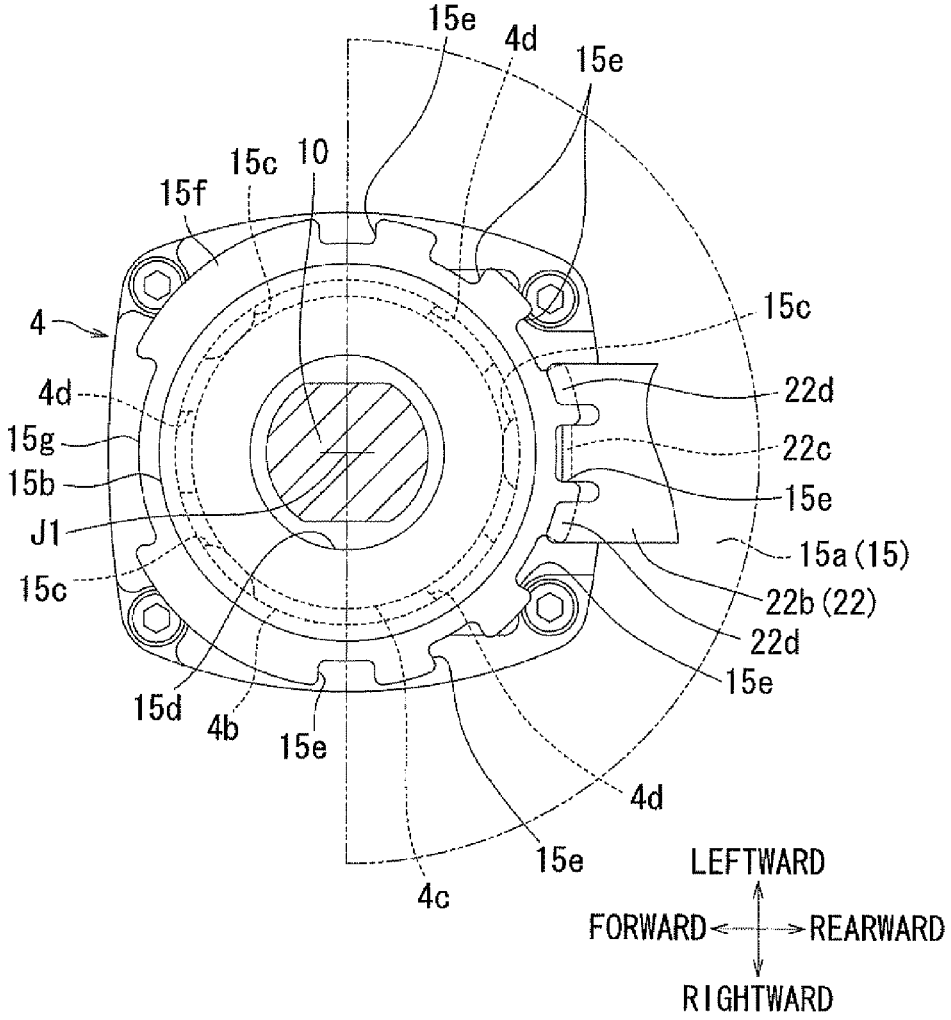
FIG. 5 is a sectional view taken along line (V)-(V) in FIG. 2 and showing the gear head device and a support portion of a cover as viewed from the lower side.

When the cover 15 is rotated about the spindle axis J1 to a front position that is displaced by an angle of 180° from the position shown in FIG. 5, the three engaging projections 15*c* are positioned to be opposed to the three removal slots 4*d*, respectively. It should be noted that the cover 15 is normally not positioned at the front position when a grinding operation is performed. Then, the engaging projections 15*c* can be removed downwardly (in a direction toward the front side of the sheet of FIG. 5) from the engaging groove 4*c* through the respective removal slots 4*d*. Hence, the cover 15 can be removed from the support boss portion 4*b* by moving the cover 15 downwardly in the direction along the spindle axis J1.

In this way, according to this example, the cover 15 is coupled to the support boss portion 4*b* of the gear head device 4 via a so-called bayonet coupling. The bayonet coupling is released to allow the cover 15 from being removed from the support boss portion 4*b* only when the cover body 15*a* is positioned at a specific position (the front position in this example) that is not normally used when a grinding operation is performed.

The position of the cover 15 about the spindle axis J1 can be fixed at any of plural positions by a one-touch operation of a lock mechanism 20 that will be hereinafter explained. The lock mechanism 20 generally includes an operation member 21 and a slider 22. The operation member 21 is positioned away from the support portion of the cover 15. Therefore, the operation member 21 can be easily operated for locking and unlocking the position of the cover 15.

Figure 4:
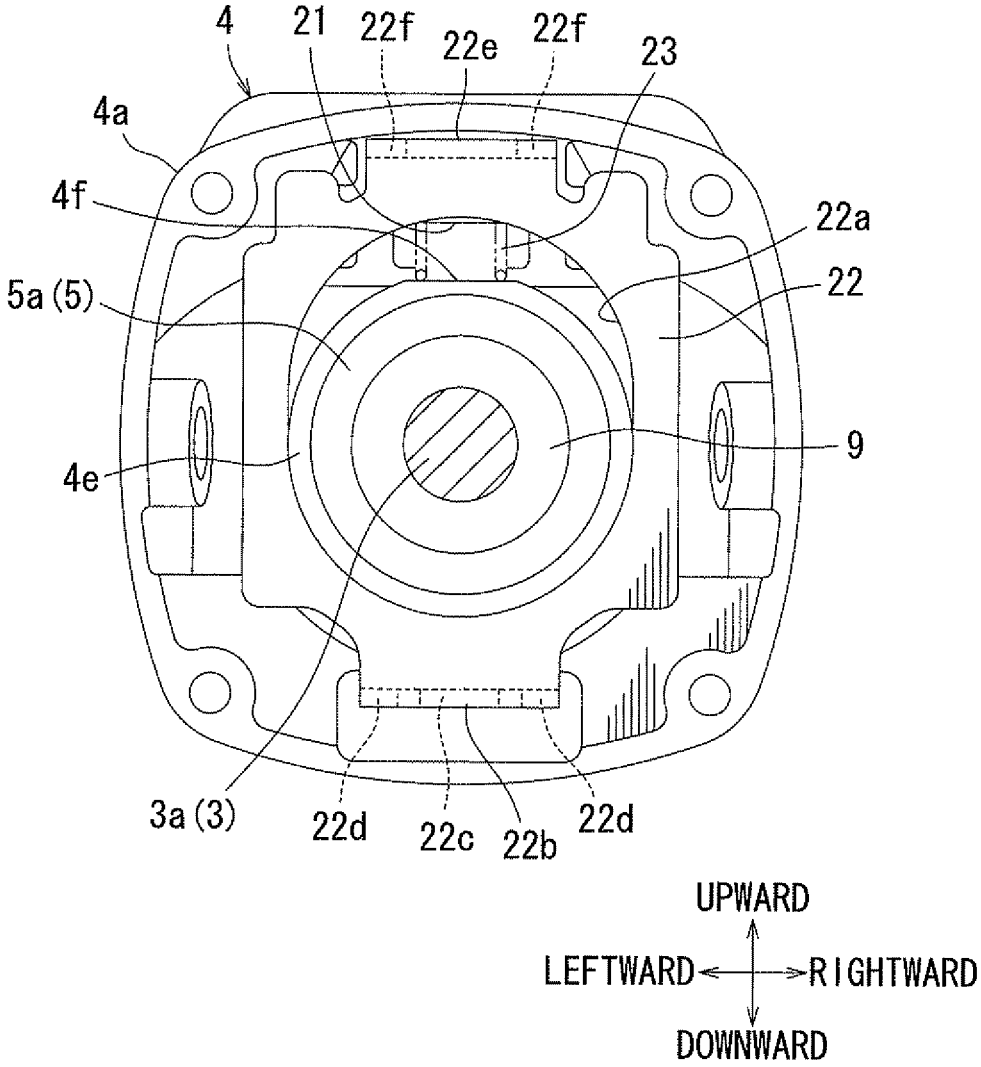
FIG. 4 is a sectional view taken along line (VI)-(VI) in FIG. 2 and showing the gear head device as viewed from its rear side.

As shown in FIG. 5, a plurality of positioning recesses 15*e* are formed in the body support portion 15*b* of the cover 15. More specifically, the positioning recesses 15*e* are formed in a flange portion 15*f* within a range of a rear half of the circumferential length of the flange portion 15*f* on the side of the cover main body 15*a* in the state shown in FIG. 2. The flange portion 15*f* is formed on the side of the upper opening of the body support portion 15*b*. In this example, seven positioning recesses 15*e* are formed so as to be spaced equally from each other in the circumferential direction. The position of the cover 15 can be locked when a lock claw 22*c* of the slider 22 engages any one of the positioning recesses 15*e*. As shown in FIG. 4, the slider 22 has a substantially rectangular flat plate-like configuration and is supported by the bearing holder portion 5 such that the slider 22 can slide vertically along the front side of the bearing holder portion 5. In this example, the sliding direction of the slider 22 is perpendicular to the motor axis J0 and is parallel to the spindle axis J1. A vertically elongated relief hole 22*a* is formed centrally of the slider 22. A cylindrical coupling boss portion 4*e* is formed on the rear portion of the gear head housing 4 and is inserted into the relief hole 22*a*, so that the slider 22 can slide vertically within a predetermined range. A coupling boss portion 5*a* of the bearing holder portion 5 is coaxially fitted into the coupling boss portion 4*e* of the gear head housing 4. The bearing 9 is supported within the coupling boss portion 5*a*. The output shaft 3*a* extends from the tool body 2 into the gear head device 4 through the relief hole 22*a* and the inner circumferential side of the coupling boss portions 4*e* and 5*a*.

The upper and lower portions of the slider 22 are bent forwardly to form L-shaped bent portions 22*e* and 22*b*, respectively. A single lock claw 22*c* and two retaining claws 22*d* are formed on the front end of the lower bent portion 22*b*. The lock claw 22*c* is bent upwardly from the central position of the front end of the lower bent portion 22*b*. The retaining claws 22*d* are positioned on opposite sides with respect to the widthwise direction of the lock claw 22*c* and extend forwardly from the lower bent portion 22*b* without changing the direction from the lower bent portion 22*b*.

As the slider 22 is slide to an upper position (lock position), the lock claw 22*c* engages one of the positioning recesses 15*e* as shown in FIG. 5, so that the cover 15 is fixed in position about the spindle axis J1. At the same time, the retaining claws 22*d* on the opposite sides of the lock claw 22 are resiliently pressed against the lower surface of the flange portion 15*f*, so that the engagement of the lock claw 22*c* with one of the positioning recesses 15*e* can be maintained.

As shown in FIG. 2, a relief groove 4*h* is formed in the lower surface of the support boss portion 4*b* at a position on the upper side of the lock claw 22*c*. When the lock claw 22*c* engages any one of the positioning recesses 15*e*, the leading end of the lock claw 22*c* enters the relief groove 4*h*. Also with this arrangement, the lock claw 22*c* can reliably be brought to engage any one of the positioning recesses 15*e*.

A relief recess 15*g* is formed in the flange portion 15*f* in addition to the seven positioning recesses 15*e* described above. The relief recess 15*g* is positioned on the opposite side of the cover body 15*a*. In other words, the relief recess 15*g* is displaced by an angle of 180° from the cover body 15*a*. In addition, the relief recess 15*g* is formed to have the width greater than the width of the lower bent portion 22*b* of the slider 22 in order to allow the bent portion 22*b* to enter the relief recess 15*g* in the direction of the spindle axis J1. As described previously, when the cover body 15*a* is positioned at the front position, which is a specific position about the axis of the spindle J1 and is not normally used for a grinding operation, the bayonet coupling between the body support portion 15*b* and the support boss portion 4*b* is released to enable removal of the cover 15 from the support boss portion 4*b*. At the same time, the lock claw 22*c* and the retaining claws 22*d* on its opposite sides are opposed to the relief recess 15*g*. Therefore, the lock claw 22*c* and the retaining claws 22*d* can pass through the flange portion 15*f* from the lower side to the upper side thereof. Hence, the body support portion 15*b* can be removed from the support boss portion 4*b* downwardly in the direction of the spindle axis J1.

Two engaging claws 22*f* are formed on the upper end of the upper bent portion 22*e* of the slider 22 and are in engagement with the operation member 21.

Figure 6:
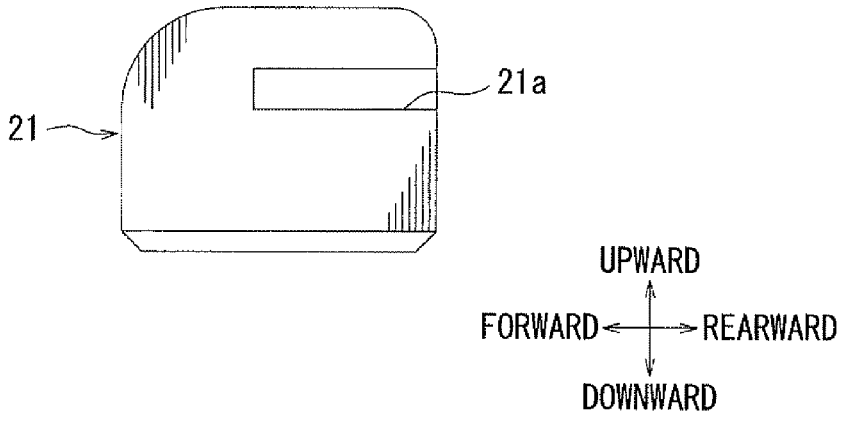
FIG. 6 is a side view of an operation member of the hand-held tool.

The operation member 21 is positioned on the upper side of the gear head device 4, so that the operation member 21 can be easily viewed from the operator. A substantially flat base portion 4*f* is formed on the upper surface of the gear head device 4 for supporting the operation member 21. Referring to FIG. 6, a pair of engaging recesses 21*a* (only one engaging recess 21*a* is shown in FIG. 6) each opened on the rear side are formed in the left and right side surface of the operation member 21. The engaging claws 22*f* of the slider 22 are inserted into the engaging recesses 21*a*, respective, from the rear side. Therefore, the operation member 21 can move vertically in unison with the slider 22. A compression spring 23 is interposed between the operation member 21 and the base portion 4*f*, so that the operation member 21 is normally biased upwardly toward a lock position by the biasing force of the compression spring 23.

When the operator presses the operation member 21 downward against the biasing force of the compression spring 23, the slider 22 moves downwardly together with the operation member 21. Then, the lock claw 22*c* positioned at the lower portion of the slider 22 engaging one of the positioning recesses 15*e* is removed from that one of the positioning recesses 15*e*, so that an unlock state is resulted to permit rotation of the cover 15 about the spindle axis J1.

The upper stroke end (lock position) of the operation member 21 is restricted by the upper stroke end of the slider 22, which is restricted through abutment of the retaining claws 22*d* provided at the lower portion of the slider 22 on the lower surface of the flange 15*f*. FIG. 2 shows the state where the operation member 21 has returned to the lock position.

A pair of restricting walls 4*g* are formed on the left and right sides of the base portion 4*f* on the upper surface of the gear head housing 4*a*. The operation member 21 is positioned between the restricting walls 4*g*. As shown in FIG. 2, the height of the restricting walls 4*g* is set such that the restricting walls 4*g* protrude slightly upward from the upper surface of the operation member 21 when the operation member 21 has returned to the lock position. The restricting walls 4*g* serve to prevent an accidental or an unintentional pressing operation (unlock operation) of the operation member 21.

Figure 3:
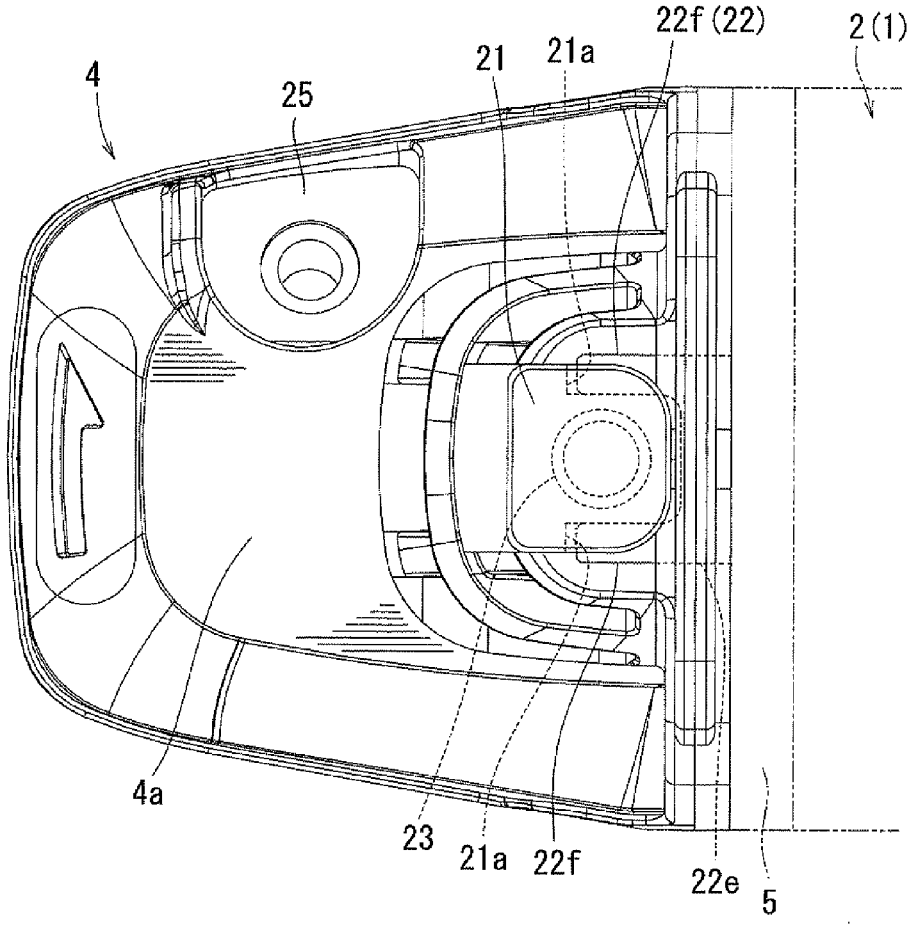
FIG. 3 is a plan view of the gear head device as viewed in a direction of arrow (III) in FIG. 2.
Figure 3:
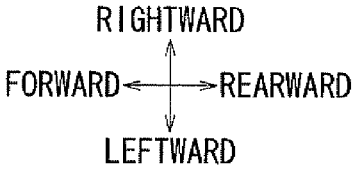

As shown in FIG. 3, a gear stopper 25 is mounted to the right side portion of the upper surface of the gear head device 4 and serves to lock the rotation of the bevel gear 6. The gear stopper 25 is normally biased upward by a compression spring 24 and has a lower portion extending into the gear head device 4 to reach a position proximal to the upper surface of the bevel gear 6. Three stopper holes 6*a* are formed in the upper surface of the bevel gear 6.

When the operator presses the gear stopper 25 against the biasing force of the compression spring 24 in the state that the electric motor 3 is stopped, the lower end portion of the gear stopper 25 can enter any one of the stopper holes 6*a*, so that the bevel gear 6 is locked not to rotate. When the pressing force applied to the gear stopper 25 is released, the gear stopper 25 returns upward by the biasing force of the compression spring 24, so that the bevel gear 6 is allowed for rotation. When the rotation of the bevel gear 6 is locked, the rotation of the spindle 10 is also locked. In the lock state of rotation of the bevel gear 6, the operations for loosening the fixing nut 12 from the threaded shaft portion 10*a* and for tightening the fixing nut 12 against the threaded shaft portion 10*a* can be easily performed. Hence, it is possible to rapidly perform a maintenance work, such as a replacement work of the end tool 11.

According to the hand-held tool 1 of the first example constructed as described above, it is possible to improve the operability of the lock mechanism 20 of the cover 15 that covers the end tool 11. In this example, the position of the cover 15 is locked when the lock claw 22*c* engages any one of the positioning recesses 15*e* positioned on the lower side of the electric motor 3 and within a region on the lower side of the motor axis J0. On the other hand, the position of the cover 15 is unlocked, enabling change of position of the cover 15 about the spindle axis J1, when the lock claw 22*c* is disengaged from the positioning recesses 15*e*.

The lock claw 22*c* is provided on the slider 22 that is vertically slidably supported between the bearing holder portion 5 and the gear head housing 4*a*. The sliding operation of the slider 22 can be made by pressing the operation member 21 downward or by releasing the pressing force applied to the operation member 21. The operation member 21 is positioned on the upper side of the slider 22 and within a region on the upper side of the motor axis J0. This means that the lock and unlock operations of the lock mechanism 20 can be preformed remotely by the operation member 21. Thus, the operation member 21 is positioned away from an engaging region, where the lock claw 22*c* engages any one of the positioning recesses 15*e*, and is positioned on the upper side of the gear head device 4, enabling the operator to easily view the operation member 21. Therefore, the hand-held tool 1 of this example is improved in the operability of the lock mechanism 20 that allows the cover 15 to be positioned and fixed without need of use of an additional tool.

In addition, at the same time the lock claw 22*c* engages one of the positioning recesses 15*e*, the retaining claws 22*d* positioned on opposite sides of the lock claw 22*c* are brought to be resiliently pressed against the lower surface of the flange portion 15*e*. Therefore, it is possible to prevent the body support portion 15*b* from being moved in the direction of the spindle axis J1 relative to the support boss portion 4*b*. As a result, the engagement of the lock claw 22*c* with one of the positioning recesses 15*e* can be reliably maintained.

Further, in the above example, the slider 22 allows the output shaft 3*a* of the electric motor 3 to be inserted into the relief hole 22*a* in the direction of thickness of the slider 22 within a region on the rear side of the spindle axis J1. Therefore, the slider 22 is positioned to extend along the bearing holder 5 within a narrow space adjacent the joint portion between the tool body 2 and the gear head device 4. In addition, because the slider 22 is slidably supported by inserting the coupling boss portion 4*e* of the gear head housing 4*a* into the relief hole 22*a*, it is possible to compactly assembling the slider 22 without need of an additional component.

Furthermore, the engaging claws 22*f* are provided at the upper portion of the slider 22 and are engaged with the engaging recesses 21*a* formed in the operation member 21, so that the operation member 21 is coupled to the upper portion of the slider 22 so as to be movable with the slider 22 in the operating direction. Therefore, the operation member 21 can be coupled to lock claw 22*c* so as to move together in the operating direction by using a simple coupling device, and eventually, it is possible to facilitate the assembling operation.

The above first example can be modified in various ways. For example, the retaining claws 22*d* of the slider 22 may be omitted. In addition, in the first example, the relieve groove 4*h* is formed in the lower surface of the support boss portion 4*b*, and the end portion of the lock claw 22*c* can enter the relief groove 4*h* for ensuring the engagement of the lock claw 22*c* with any one of the positioning recesses 15*e*. However, the relief groove 4*h* may be omitted.

Figure 7:
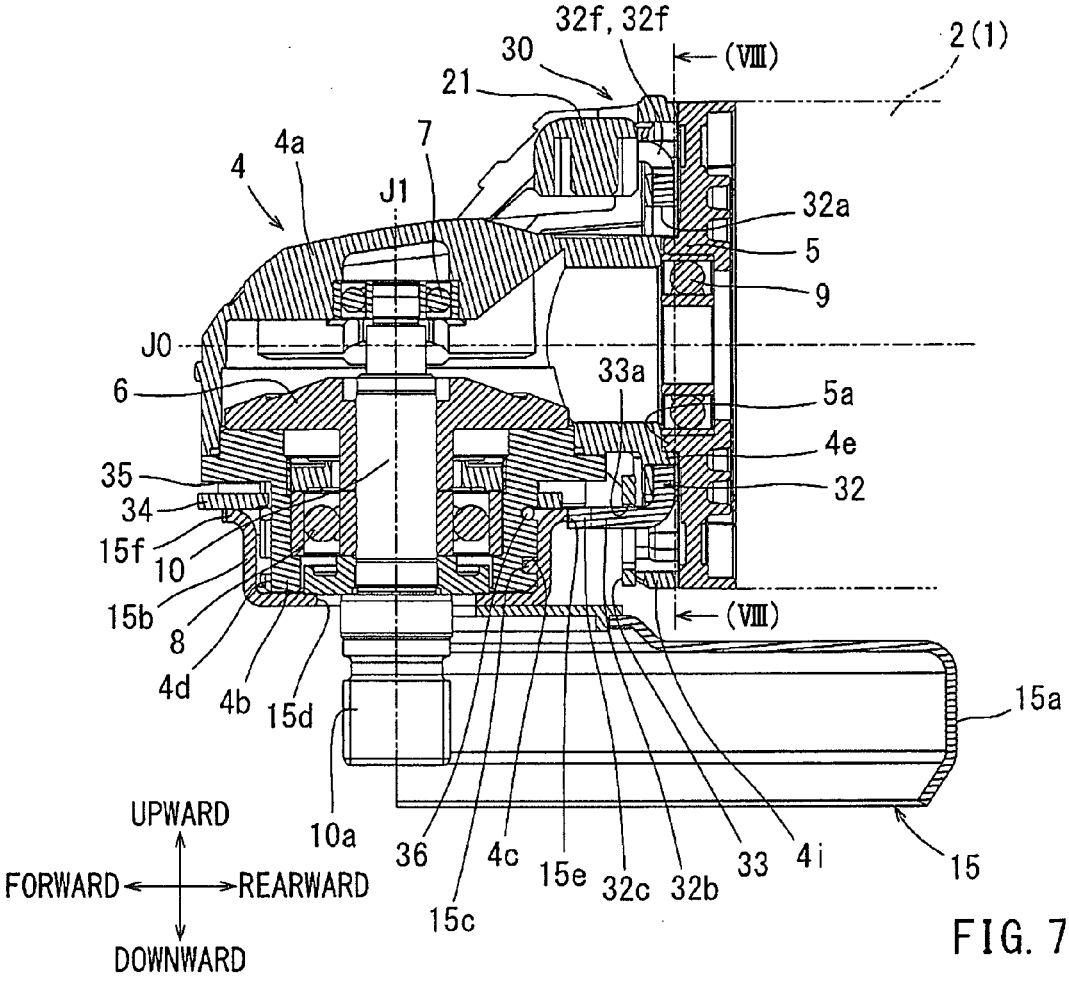
FIG. 7 is a vertical sectional view of a gear head device of a hand-held tool according to a second example showing the state where an end tool, a fixing nut and a support flange are removed from a spindle, while a tool body, an electric motor and its output shaft are not shown for the purpose of illustration.
Figure 8:
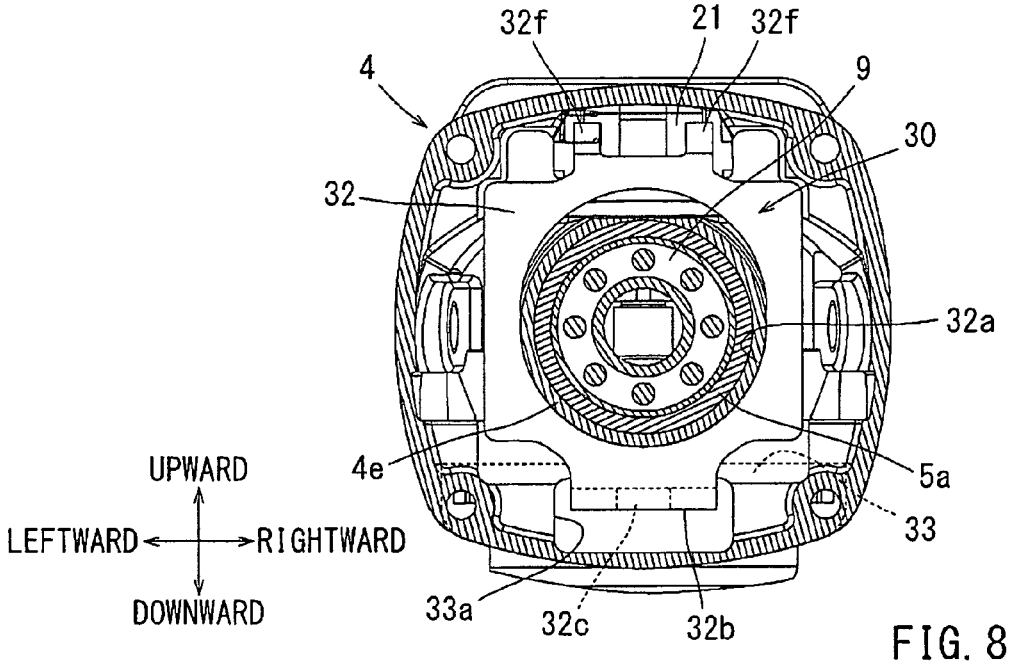
FIG. 8 is a sectional view taken along line (VIII)-(VIII) in FIG. 7.

A second example will now be described with reference to FIGS. 7 to 9. The second example is a modification of the first example. Therefore, in FIGS. 7 to 9, like members are given the same reference numerals as the first example and the description of these members will not be repeated. The second example is different from the first example mainly in that a lock mechanism 30 of the second example is differently configured from the lock mechanism 20 and that a slider 32 (in particular its lock claw 32*c* and a portion proximal to the lock claw 32*c*) has a mechanical strength that is higher than the slider 22 of the first example. In addition, the second example is configured to further reliably prevent the body support portion 15*b* of the cover 15 from moving relative to the support boss portion 4*b* of the gear head device 4.

Similar to the slider 22 of the first example, the slider 32 has a substantially rectangular flat plate-like configuration and includes a vertically elongated relief hole 32*a*, into which the coupling boss portion 4*e* of the gear head device 4 is inserted, so that the slider 32 can slide vertically along the front surface of the bearing holder portion 5. Also, engaging claws 32*f* similar to the engaging claws 22*f* are formed on the upper portion of the slider 32 and engage with the operation member 21, and the operation member 21 is biased upward (toward the lock position) by the compression spring 23 (not shown in FIGS. 7 to 9).

Therefore, when the operation member 21 is pressed downward against the biasing force of the compression spring 23, the slider 32 moves downward to unlock the lock mechanism 30. When the downwardly pressing force applied to the operation member 21 is released, the slider 32 moves upward by the biasing force of the compression spring 23, so that the position of the cover 15 about the spindle axis J1 is locked.

In the second example, the slider 32 has a thickness of 3.2 mm that is about twice the thickness of the slider 22 of the first example. Preferably, the slider 32 is formed of a relatively thick steel plate that is formed into the slider 32 by using a sheet-metal processing technique.

A bent portion 32*b* is formed on the lower portion of the slider 32 and is bent forwardly (toward the gear head device 4) to have an L-shape. A reinforcing plate 33 is mounted to a lower portion of a mount flange 4*i* formed on the gear head housing 4*a*. The reinforcing plate 33 has an insertion window 33*a* formed therein, through which the bent portion 32*b* can protrude forwardly. The reinforcing plate 33 is formed of a steel plate having a higher strength and a higher hardness than the material used for the gear head housing 4*a*. Due to the incorporation of the reinforcing plate 33, when a large impact is applied to the cover 15 in a direction about the spindle axis J1, such an impact is applied to the bent portion 32*b* in a direction parallel to the surface of the bent portion 32*b* via the lock claw 32*c* engaging one of the positioning recesses 15*e*. However, the bent portion 32*b* is brought to contact the edge portion of the insertion window 33*a*, so that the reinforcing plate 33 can receive the impact. Therefore, it is possible to prevent the potential damage of the mount flange 4*i* of the gear head housing 4*a*. As a result, the durability of the gear head housing 4*a* can be improved.

The lock claw 32*c* is formed on the central portion of the front end of the bent portion 32*b* that protrudes forwardly from the insertion window 33*a*. The lock claw 32*c* in this example is not bent upwardly as in the case of the lock claw 22*c* of the first example but extends forwardly from the front end of the bent portion 32*b* within the same plane. In addition, in the second example, no parts corresponding to the retaining claws 22*d* are provided.

As the slider 32 moves upward to the lock position by the biasing force of the compression spring 23, the lock claw 32*c* moves into any one of the positioning recesses 15*e* of the cover 15, so that the position of the cover 15 about the spindle axis J1 is locked. FIG. 7 shows the lock state of the cover 15. As the operator presses the operation member 21 downward against the biasing force of the compression spring 23, the slider 32 moves downwardly, and the lock claw 32*c* is removed downwardly from the engaged positioning recess 15*e*, so that the position of the cover 15 about the spindle axis J1 is unlocked to allow change of position of the cover 15.

Figure 9:
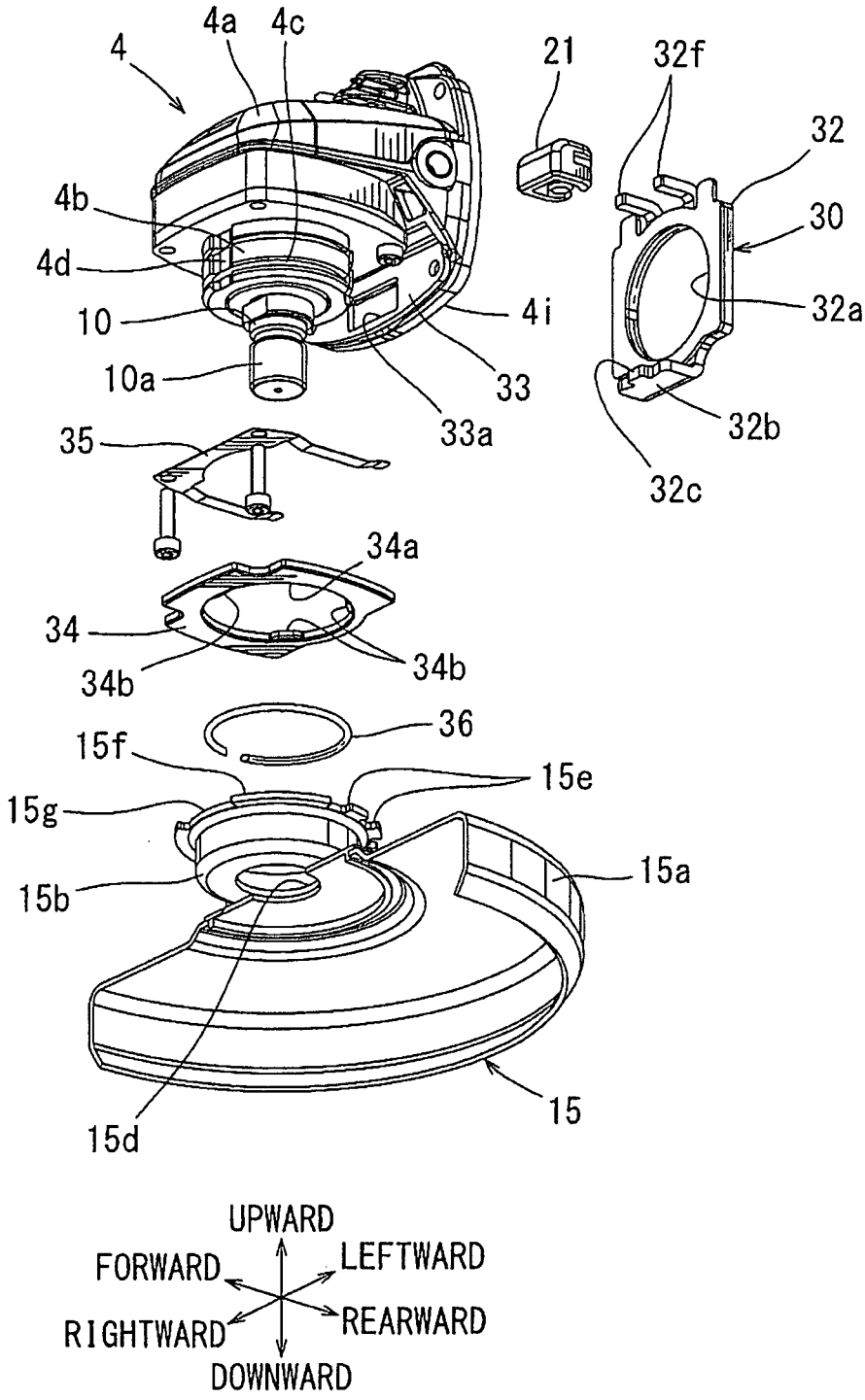
FIG. 9 is an exploded perspective view of the gear head cover of the second example, while the tool body and the end tool are not shown for the purpose of illustration.

As shown in FIG. 9, a resilient member 35 is interposed between the body support portion 15*b* of the cover 15 and the gear head housing 4*a* to inhibit or suppress the movement relative to each other. In this example, the resilient member 35 is a leaf spring. The resilient member 35 is held between the upper surface of the support boss portion 4*b* of the gear head housing 4*a* and a holder plate 34 supported on the support boss portion 4*b*. The holder plate 34 is configured as a substantially annular flat plate and has a central circular hole 34*a*, into which the support boss portion 4*b* is inserted for supporting the holder plate 34. Because the biasing force of the resilient member 35 is applied to the body support portion 15*b* via the holder plate 34, it is possible to inhibit or suppress the movement of the body support portion 15*b* relative to the support boss portion 4*b*.

Three engaging projections 34*b* are formed on the circumferential surface of the central hole 34*a* of the holder plate 34. A metal stopper ring 36 is attached to the outer circumference of the support boss portion 4*b*. The engaging projections 34*b* engage the stopper ring 36, so that the holder plate 34 is prevented from moving downward and eventually from being accidentally removed from the support boss portion 4*b*, for example, in the state that the cover 15 has been removed. The stopper ring 36 of the second example is attached to the outer circumference of the support boss portion 4*b* at a position that is slightly upward of the attaching position of the rubber ring 16 of the first example with respect to the direction of the spindle axis J1 and is substantially the same level as the upper surface of the flange 15*f* of the body support portion 15*b*. No member corresponding to the rubber ring 16 for slidably contacting the inner circumferential surface of the body support portion 15*b* is provided in the second example. Thus, in the second example, the movement of the body support portion 15*b* relative to the support boss portion 4*b* is prevented or suppressed by the biasing force of the resilient member 35 without use of the rubber ring 16 of the first example.

Similar to the engaging projections 15*c* of the body support portion 15*b*, the engaging projections 34*b* are unequally spaced from each other. The holder plate 34 is mounted to the support boss portion 4*b* by inserting the engaging projections 34*b* into the removal slots 4*d* at a given position about the spindle axis J1.

Also with the lock mechanism 30 of the cover 15 of the hand-held tool 1 according to the second example, it is possible to achieve the same advantages as those of the lock mechanism 20 of the first example. In addition, in the second example, the thickness of the lock claw 32*c* and the bent portion 32*b* of the slider 32 is larger than that of the corresponding parts of the first example. Therefore, the strength and the rigidness of these parts are improved.

The first and second examples may be further modified in various ways. For example, although the compression spring 23 is used for biasing the operation member 21 toward the lock position, the compression spring 23 may be replaced with any other spring, such as a leaf spring and a torsion spring, or may be replaced with any other biasing member, such as urethane rubber.

Further, although the operation member 21 is configured as a push button that is pushed against the biasing force of the compression spring 23, the operation member 21 may be replaced with an operation lever that pivots vertically against the biasing force.

Furthermore, the operation member 21 may be positioned at any position, such as a position on the left or right side of the gear head device and a position on an upper side of the tool body, as long as the operation member 21 can be easily viewed by the operator.

Furthermore, although the output shaft 3*a* of the electric motor 3 is inserted into the central relief hole 22*a* (32*a*) formed in the slider 22 (32), the relief hole may be replaced with any other configuration as long as it allows insertion of the output shaft 3*a*. For example, the slider may have a C-shaped relief portion defining a relief hole therein.

Furthermore, although the coupling boss portion 4*e* of the gear head housing 4 and the coupling boss portion 5*a* of the bearing holder 5 are inserted into the relief hole 22*a* (32*a*) for vertically slidably supporting the slider 22, it may be possible to vertically slidably support the slider by a pair of rails each having a U-shaped cross section and slidably contacting the left and right side surfaces of the slider.

Furthermore, although the resilient member 35 in the second example is a leaf spring, the resilient member 35 may be a compression spring, urethane rubber or any other suitable resilient ember.

Furthermore, the lock claw 22*c* (32*c*) and the engaging claw 22*f* may have any other shapes than the claw shapes.

Furthermore, although the hand-held tools of the above examples are configured as disk grinders, the teachings of the above examples also may be applied to any other hand-held tools, such as a disk sander or a polisher used for cutting, abrading, polishing or finishing.

What is claimed is:

1. A hand-held tool comprising:

a tool body having an electric motor disposed therein, the electric motor having a motor axis;

a gear head device mounted to the tool body and having a spindle and a gear mechanism, the gear mechanism being coupled to the electric motor and transmitting rotation of the electric motor to the spindle, the spindle having a spindle axis;

a cover configured to cover at least a part of an end tool mounted to the spindle;

a coupling device coupling the cover to the gear head device, so that the cover can move relative to the gear head device;

a lock mechanism configured to lock and unlock a position of the cover relative to the gear head device; and an operation member operably coupled to the lock mechanism and positioned on a side opposite to the coupling device of the cover with respect to the motor axis;

wherein the lock mechanism includes a lock claw engaging the cover and fixing the cover in position relative to the end tool, and a biasing member applying a biasing force to the lock claw in a direction toward a lock position, wherein the operation member is operable to unlock the position of the cover against the biasing force of the biasing member; and wherein the lock mechanism further includes a slider disposed on a rear side of the spindle and transmitting the lock and unlock operations of the operation member to the lock claw, the slider having a relief portion through which an output shaft of the electric motor extends.

2. The hand-held tool as in claim 1, wherein the gear head device is disposed at a front portion of the tool body.

3. The hand-held tool as in claim 1, wherein the lock mechanism further includes a retaining claw retaining the cover at a mounting position to the gear head device by the biasing force of the biasing member.

4. The hand-held tool as in claim 1, further comprising a resilient member interposed between the cover and the gear head device, wherein the resilient member biases the cover in a direction of the spindle axis.

5. The hand-held tool as in claim 1, wherein the slider has a first end and a second end positioned on an opposite side of the first end with respect to the motor axis, and the first end is coupled to the operation member, so that the slider moves by the operation of the operation member.

6. The hand-held tool as in claim 5, wherein the second end has the lock claw engaging and disengaging a part of the cover according to the movement of the slider.

7. The hand-held tool as in claim 5, wherein the slider moves within a plane intersecting with the motor axis.

8. The hand-held tool as in claim 5, wherein the tool body and the gear head device have end portions opposed to each other, and the slider is positioned proximal to the end portions.

9. The hand-held tool as in claim 5, wherein the slider moves in a direction substantially parallel to the spindle axis by the operation of the operation member.

10. The hand-held tool as in claim 9, wherein the spindle axis is perpendicular to the motor axis.

11. The hand-held tool as in claim 1, further comprising a bearing holder portion mounted to the tool body, wherein the bearing holder portion holds a bearing rotatably supporting the output shaft of the electric motor, and wherein the slider is supported by the bearing holder portion so as to be movable in a lock direction and an unlock direction.

12. The hand-held tool as in claim 1, wherein the slider has an engaging portion engaging with the operation member, so that the slider moves together with the operation member in moving directions of the operation member for the lock and unlock operations.

* * * * *